US011434710B2

(12) United States Patent
Goad, Jr. et al.

(10) Patent No.: US 11,434,710 B2
(45) Date of Patent: Sep. 6, 2022

(54) LINER HANGER AND METHOD

(71) Applicant: INNOVEX DOWNHOLE SOLUTIONS, INC., Houston, TX (US)

(72) Inventors: Bobby F. Goad, Jr., Houston, TX (US); Srihari Chebolu, Houston, TX (US); Evan Lowe, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 113 days.

(21) Appl. No.: 16/938,321

(22) Filed: Jul. 24, 2020

(65) Prior Publication Data

US 2022/0025724 A1 Jan. 27, 2022

(51) Int. Cl.

| | |
|---|---|
| ***E21B 23/04*** | (2006.01) |
| ***E21B 33/12*** | (2006.01) |
| ***E21B 43/10*** | (2006.01) |

(52) U.S. Cl.

CPC ..... *E21B 23/0411* (2020.05); *E21B 33/12* (2013.01); *E21B 43/10* (2013.01)

(58) Field of Classification Search

CPC ..... E21B 23/04; E21B 23/0411; E21B 33/12; E21B 43/10

See application file for complete search history.

(56) References Cited

U.S. PATENT DOCUMENTS 3,291,220 A * 12/1966 Mott ..... E21B 23/04 166/208
4,096,913 A * 6/1978 Kenneday ..... E21B 23/006 166/120
4,363,358 A * 12/1982 Ellis ..... E21B 23/04 166/181
4,423,777 A * 1/1984 Mullins ..... E21B 33/1295 166/120
4,479,544 A 10/1984 Callihan et al.
(Continued)

FOREIGN PATENT DOCUMENTS

| | | |
|---|---|---|
| CN | 102587852 A | 7/2012 |
| WO | 2007-008455 A1 | 1/2007 |

OTHER PUBLICATIONS

Seung Hoon Bahng (Authorized Officer), International Search Report and Written Opinion dated Nov. 1, 2021, PCT Application No. PCT/US2021/041716, 11 pages.

*Primary Examiner* — Steven A Macdonald
(74) *Attorney, Agent, or Firm* — MH2 Technology Law Group LLP

(57) ABSTRACT

A downhole tool includes a mandrel configured to be coupled to a liner, the mandrel defining a first port and a second port, the first and second ports being axially offset from one another and extending radially through a wall of the mandrel, a slips assembly coupled to the mandrel, an outer cylinder received around the mandrel and configured to transmit an axially-directed force onto the slips assembly, and a retaining assembly positioned radially between the mandrel and the outer cylinder. The retaining assembly has a first configuration that prevents the outer cylinder from moving relative to the mandrel, and a second configuration that permits the outer cylinder to move axially along the mandrel and set the slips assembly. The retaining assembly is configured to actuate from the first configuration to the second configuration in response to a pressure in the first port exceeding a pressure in the second port.

21 Claims, 5 Drawing Sheets

(56) References Cited

U.S. PATENT DOCUMENTS

| | | | | |
|---|---|---|---|---|
| 4,624,311 | A * | 11/1986 | Goad | E21B 23/04 166/125 |
| 7,766,088 | B2 * | 8/2010 | Saucier | E21B 43/10 166/382 |
| 9,074,437 | B2 * | 7/2015 | Stingerie | E21B 23/00 |
| 9,816,357 | B2 * | 11/2017 | Abraham | E21B 43/10 |
| 2007/0007014 | A1 * | 1/2007 | Sessions | E21B 23/06 166/374 |
| 2013/0092369 | A1 | 4/2013 | Stingerie | |
| 2013/0327516 | A1 * | 12/2013 | Stingerie | E21B 23/00 166/191 |
| 2015/0101827 | A1 * | 4/2015 | Abraham | E21B 23/01 166/382 |
| 2018/0347308 | A1 | 12/2018 | Burke et al. | |
| 2020/0340307 | A1 * | 10/2020 | El Mallawany | E21B 23/04 |

* cited by examiner

LINER HANGER AND METHOD

BACKGROUND

Wellbores are drilled and completed to produce hydrocarbons from a subterranean formation. Once at least a portion of the wellbore is drilled, a casing may be inserted into the wellbore. Cement may then fill the annulus between the casing and the wellbore, so as to set the casing in place and prevent migration of fluids in the annulus between the casing and the wellbore wall.

In some situations, after the casing has been installed, it may be desirable to continue drilling the hole. In such situations, a drill string and bottom-hole assembly are extended down past the casing to lengthen the wellbore. A liner may then be installed, through the casing, and cemented in place below the casing.

A liner hanger may be used to hold the liner in place. The liner hanger supports the liner in tension, so as to prevent buckling in response to thermal expansion. In some cases, the liner hanger may mechanically engage the casing and suspend the liner string therefrom. When using such liner hangers, care is taken to avoid setting the liner hanger too early, e.g., above the distal end of the casing. However, in the high-pressure environment deep in a well, this can be a challenge.

SUMMARY

Embodiments of the disclosure may provide a downhole tool that includes a mandrel configured to be coupled to a liner, the mandrel defining a first port and a second port, the first and second ports being axially offset from one another and extending radially through a wall of the mandrel, a slips assembly coupled to the mandrel, an outer cylinder received around the mandrel and configured to transmit an axially-directed force onto the slips assembly, and a retaining assembly positioned radially between the mandrel and the outer cylinder. The retaining assembly has a first configuration that prevents the outer cylinder from moving relative to the mandrel, and a second configuration that permits the outer cylinder to move axially along the mandrel and set the slips assembly. The retaining assembly is configured to actuate from the first configuration to the second configuration in response to a pressure in the first port exceeding a pressure in the second port.

Embodiments of the disclosure may also provide a method for setting a downhole tool in a surrounding tubular. The method includes deploying the downhole tool into the surrounding tubular. The downhole tool includes a mandrel configured to be coupled to a liner, the mandrel defining a first port and a second port, the first and second ports being axially offset from one another and extending radially through a wall of the mandrel, a slips assembly coupled to the mandrel, an outer cylinder received around the mandrel and configured to transmit an axially-directed force onto the slips assembly, and a retaining assembly positioned radially between the mandrel and the outer cylinder. The retaining assembly has a first configuration that prevents the outer cylinder from moving relative to the mandrel, and a second configuration that permits the outer cylinder to move axially along the mandrel and set the slips assembly. The retaining assembly is configured to actuate from the first configuration to the second configuration in response to a pressure in the first port exceeding a pressure in the second port. The method also includes actuating the retaining assembly from the first configuration to the second configuration by increasing a pressure differential between the first and second ports in the mandrel, and after actuating the retaining assembly, pressing the slips assembly radially outwards into engagement with the surrounding tubular.

Embodiments of the disclosure may further provide a downhole tool that includes a mandrel configured to be coupled to a liner, the mandrel defining a first port and a second port, the first and second ports being axially offset from one another and extending radially through a wall of the mandrel, a slips assembly coupled to the mandrel, an outer cylinder received around the mandrel and configured to axially engage the slips assembly, and a retaining assembly positioned radially between the mandrel and the outer cylinder. The retaining assembly has a first configuration that prevents the outer cylinder from moving relative to the mandrel, and a second configuration that permits the outer cylinder to move axially along the mandrel and set the slips assembly. The retaining assembly is configured to actuate from the first configuration to the second configuration in response to a pressure in the first port exceeding a pressure in the second port. The retaining assembly includes a detent ring having an enlarged section received into a recess in the outer cylinder in the first configuration. The enlarged section is pressed radially inward from the recess in the second configuration. The retaining assembly also includes a piston that prevents the enlarged section of the detent from moving radially inward in the first configuration, and wherein the piston permits the enlarged section of the detent to move radially inward in the second configuration. In the first configuration, the piston is at least partially radially between the mandrel and the detent ring, and in the second configuration, the piston is not radially between the mandrel and the detent ring.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
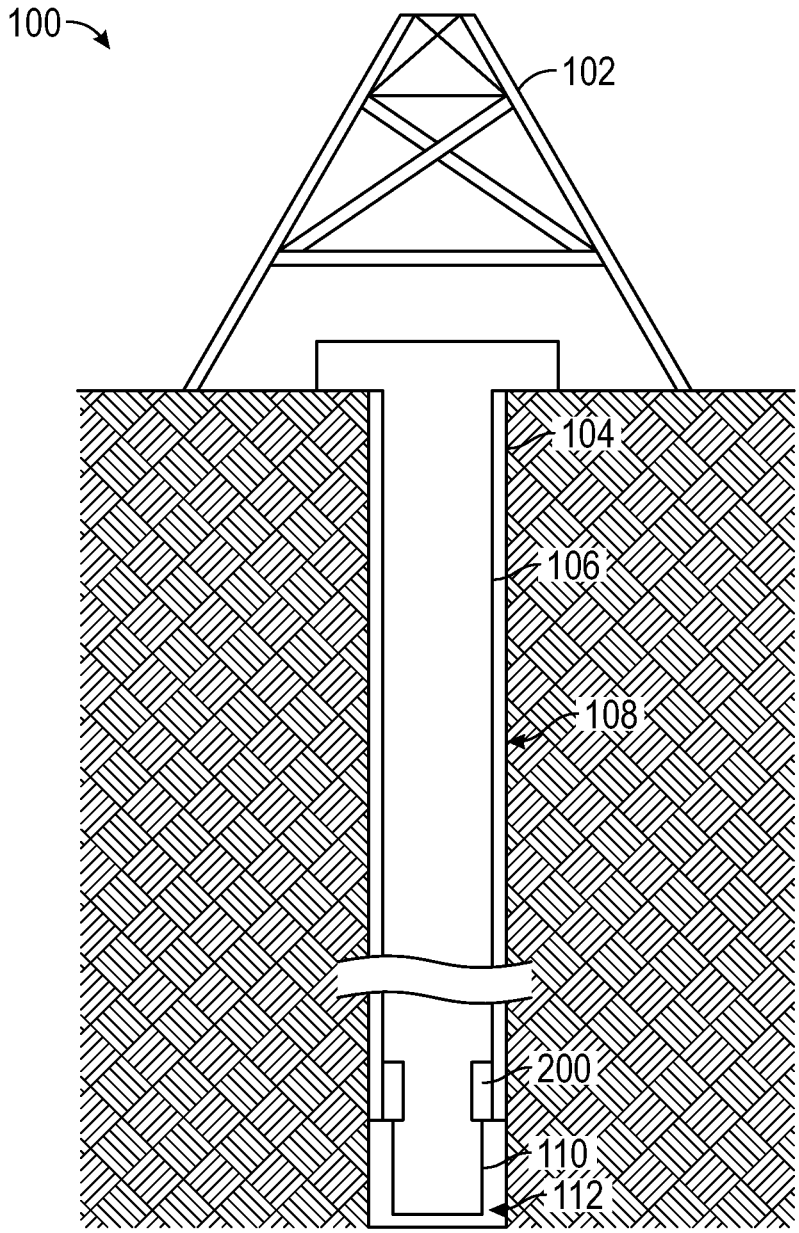
FIG. 1 illustrates a side, conceptual view of a wellsite, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, conceptual view of a wellsite 100, according to an embodiment. The wellsite 100 may include a drilling rig 102, e.g., a derrick positioned on a top surface 103 (e.g., the ground) and including tubular handling and running equipment, mud pumps, rotation equipment, drilling equipment, cement pumps, etc. The drilling rig 102 may be employed to drill, complete, and/or produce hydrocarbons from a wellbore 104. Although the wellbore 104 is depicted as being vertical, it will be appreciated that the wellbore 104 may be deviated, horizontal, etc.

A casing 106 may be installed in the wellbore 104 using the drilling rig 102. The casing 106 may be a string of casing tubulars, which are run into the wellbore 104, thereby forming an annulus 108 between the casing 106 and the wellbore 104. Cement equipment may be employed to pump cement through the casing 106 and back up into the annulus 108 toward the surface 103.

A liner 110 may also be installed in the wellbore 104. The liner 110 may be run into the wellbore 104 through the casing 106. At a top or proximal end, the liner 110 may be connected to a liner hanger 200, which may secure to the interior of the casing 106, allowing the liner 110 to hang from the casing 106 via the liner hanger 200. The liner 110 may form an annulus 112 with the wellbore 104, below the casing 106, and, as with the casing 106, may be cemented into place by filling the annulus 112 with cement.

Figure 2:
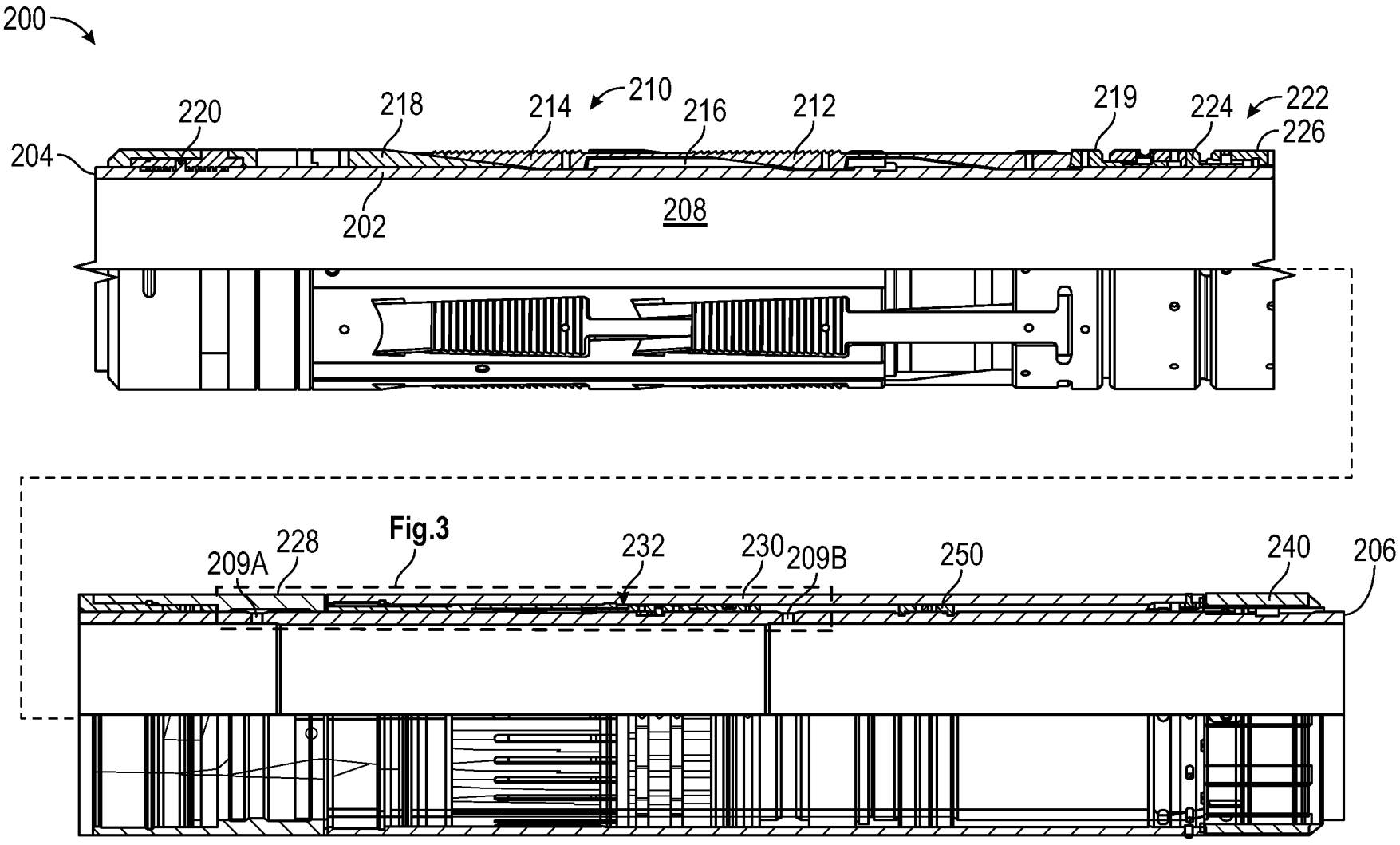
FIG. 2 illustrates a side, half-sectional view of the liner hanger, according to an embodiment.

FIG. 2 illustrates a side, half-sectional view of the liner hanger 200, according to an embodiment. The liner hanger 200 is an example of a downhole tool, as it is deployed for use in a wellbore; however, it will be appreciated that aspects of the present embodiments may be tailored for use with other types of downhole tools.

The liner hanger 200 may include a mandrel 202. The mandrel 202 may be a hollow, tubular member or combination of members, that extends the length of the liner hanger 200. The mandrel 202 may have an upper end 204 and a lower end 206. The lower end 206 may be configured to be attached to a liner, e.g., a string of tubulars that extends down past the casing in the wellbore. The mandrel 202 may define a bore 208 therein, which extends longitudinally therethrough from the upper end 204 to the lower end 206. The mandrel 202 may further define a first port 209A and a second port 209B radially through a wall of the mandrel 202, such that fluid communication is possible from within the bore 208 to outside of the mandrel 202 via the ports 209A, 209B. The ports 209A, 209B may be axially offset from one another, as shown.

The liner hanger 200 may also include a slips assembly 210 positioned around the mandrel 202. The slips assembly 210 may include one or more slips, e.g., slips 212, 214. The slips 212, 214 may include teeth or other marking/gripping members, which are configured to engage and anchor within a surrounding tubular, such as casing. The slips assembly 210 may further include one or more cones (two shown: 216, 218), which may be positioned adjacent to the slips 212, 214. The cones 216, 218 may be generally wedge-shaped, and may provide a tapered surface that abuts an inner surface of the slips 212, 214. Accordingly, when the slips 212, 214 are driven axially against the cones 216, 218, the cones 216, 218 act as wedges, driving the slips 212, 214 radially outward.

The slips assembly 210 may also include a slips retainer 219, in which at least some of the slips 212 maybe received and, e.g., pivotally retained. In some embodiments, the slips retainer 219 may be configured to transmit axial loads to the slips 212, 214, as will be described in greater detail below.

The liner hanger 200 may also include an upper collar 220 (e.g., a clamp ring), which may be secured to the mandrel 202 so as to resist movement with respect thereto. The upper collar 220 may bear against the slips assembly 210, e.g., to prevent the slips assembly 210 from moving axially past the upper collar 220. Accordingly, the upper collar 220 may provide an end-range for movement of the slips assembly 210, allowing the cones 216, 218 to force the slips 212, 214 radially outwards in response to axial loading.

The liner hanger 200 may also include a force-transmission assembly 222, which may include one or more rings, e.g., an adjusting ring 224, a push ring 226, and a housing 228, which are positioned around the mandrel 202 and axially-adjacent to one another. In an embodiment, the housing 228 may partially overlap and form a seal with the push ring 226. In some embodiments, one or more of the elements, or the force-transmission assembly 222 in total, may be omitted, and thus should be considered optional unless otherwise specified herein.

An outer cylinder 230 may be positioned axially adjacent to the force-transmission assembly 222 (or to the slips assembly 210, if the force-transmission assembly 222 is omitted). The outer cylinder 230 may be spaced radially apart from the mandrel 202, such that an annulus 232 is defined therebetween. A retaining assembly may be positioned within the annulus, as will be described in greater detail below. The retaining assembly may have a first configuration in which the retaining assembly prevents the outer cylinder 230 from moving axially with respect to the mandrel 202, and a second configuration in which the retaining assembly permits the outer cylinder 230 to move, e.g., by pressure within the wellbore, in an uphole direction, into engagement with the force-transmission assembly 222 or directly with the slips assembly 210, so as to compress the slips assembly 210 between the outer cylinder 230 and the upper collar 220.

The liner hanger 200 may also include a lower collar 240, which may be received around the mandrel 202 and, e.g., secured to the outer cylinder 230. The lower collar 240 may thus be movable along with the outer cylinder 230, e.g., in response to fluid pressure from downhole of the lower collar 240. A seal 250 may be positioned within the annulus 232, e.g., above the lower collar 240, so as to limit ingress of fluid into the annulus 232, while allowing for movement of the outer cylinder 230 and/or the lower collar 240. The seal 250 may be secured in place with respect to the mandrel 202.

Figure 3:
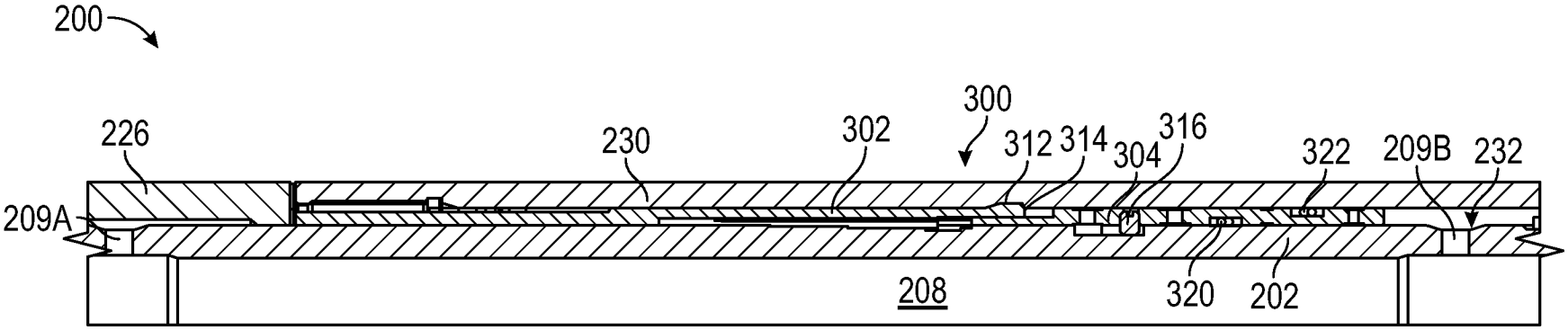
FIG. 3 illustrates a side, cross-sectional view of a portion of the liner hanger, showing a retaining assembly thereof in a first configuration, according to an embodiment.

FIG. 3 illustrates a side, cross-sectional view of a portion of the liner hanger 200, according to an embodiment. The portion illustrated in FIG. 3 is indicated in FIG. 2, for reference. As shown, in the annulus 232 between the mandrel 202 and the outer cylinder 230, and axially between the first and second ports 209A, 209B, there is a retaining assembly 300. In an embodiment, the retaining assembly 300 may include a detent ring 302 and a piston 304. The detent ring 302 may be secured from moving axially relative to the mandrel 202 in a variety of ways, e.g., by being directly connected to the mandrel 202, or via one or more other pieces, such as using profiled mandrels, block rings, collars, etc.

The detent ring 302 includes an enlarged section 312, which fits into a recess 314 formed in the outer cylinder 230. The enlarged section 312 may be formed at an end of the detent ring 302, but in other embodiments, may be formed elsewhere along the detent ring 302 (e.g., the middle). In a first configuration of the retaining assembly 300, as illustrated in FIG. 3, the enlarged section 312 is retained in the recess 314 by the piston 304. Further, the enlarged section 312 being retrained in the recess 314 transmits axial loads on the outer cylinder 230 to the mandrel 202, thereby locking the outer cylinder 230 in position relative to the mandrel 202 and preventing the outer cylinder 230 from pressing against the force-transmission assembly 222.

The piston 304 may be positioned at least partially radially between the detent ring 302 and the mandrel 202 when the retaining assembly 300 is in the first configuration. For example, the piston 304 may be directly between the enlarged section 312 and the mandrel 202, thereby preventing the enlarged section 312 from dislodging from the recess 314. Further, the piston 304 may be held in position by one or more shearable members 316, e.g., a shear pin, shear screw, shear threads, shear ring, etc., which hold the piston 304 in place relative to the mandrel 202.

In at least some embodiments, the piston 304 may include an inner seal 320 and an outer seal 322. The inner seal 320 may form a seal with the mandrel 202 and the outer seal 322 may form a seal with the outer cylinder 230. The seals 320, 322 may prevent fluid communication axially across the piston 304, which may permit a pressure differential to be developed in the annulus 232 on either axial side of the piston 304.

Figure 4:
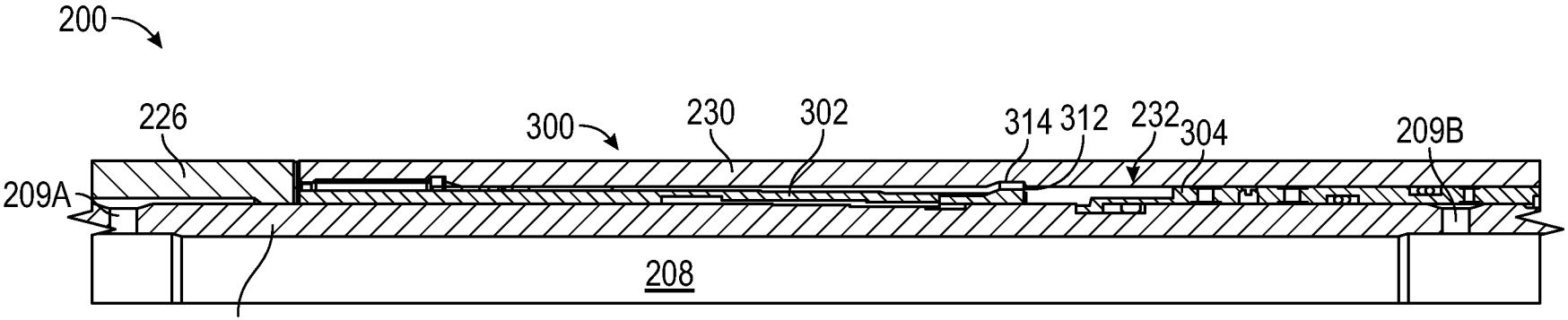
FIG. 4 illustrates a side, cross-sectional view of a portion of the liner hanger, showing the retaining assembly in a second configuration, according to an embodiment.

As shown in FIG. 4, the retaining assembly 300 may be actuatable from the first configuration to a second configuration. In the illustrated second configuration, the piston 304 has moved in a downhole direction (to the right, in this view) and is no longer radially between the detent ring 302 and the mandrel 202. For example, the piston 304 may be moved downhole until it engages a stop member or otherwise moves away from the detent ring 302. In some embodiments, when the retaining assembly 300 is in the second configuration, the piston 304 may cover and, e.g., seal the second port 209B.

As the piston 304 has moved away from the detent ring 302, the detent ring 302 is free to bend, flex, or otherwise move radially inward, toward the mandrel 202. For example, the mandrel 202 may have a tapered region to accommodate such flexing, but in other embodiments, such tapering may not be provided. This may allow the enlarged section 312 to be dislodged from the recess 314 in the outer cylinder 230. For example, pressure applied from below the liner hanger 200 may generate a force on the outer cylinder 230 that is directed in the uphole direction. This force may, in turn, press the enlarged section 312 of the detent ring 302 radially inward, and the detent ring 302 may flex radially inward, allowing the enlarged section 312 to come out of the recess 314. When this happens, the outer cylinder 230 is free to move axially with respect to the mandrel 202. The outer cylinder 230 may thus move in the uphole direction, again under the pressure from below the liner hanger 200, and press against the force-transmission assembly 222 (or directly against the slips assembly 210 of FIG. 2). Referring again to FIG. 2, this force may be transmitted to the slips assembly 210, such that the slips 212, 214 and cones 216, 218 are pressed against the upper collar 220 and compressed between the force-transmission assembly 222 and the upper collar 220. In turn, this may cause the slips 212, 212 to ride up the cones 216, 218, and thereby move radially outwards and into anchoring engagement with the surrounding tubular.

Referring again to FIGS. 3 and 4, to actuate from the first configuration to the second configuration, a pressure differential across the piston 304 is generated, which shears the shearable member 316 and forces the piston 304 to move away from the detent ring 302 (e.g., in the downhole direction). This pressure differential may be generated by applying different pressures to the first port 209A and the second port 209B, e.g., high pressure in the first port 209A, and lower pressure in the second port 209B. The ports 209A, 209B may both communicate with the piston 304, but may be prevented from communicating with one another via the annulus 232, because the piston 304 seals the annulus 232 between the first and second ports 209A, 209B.

Figure 5:
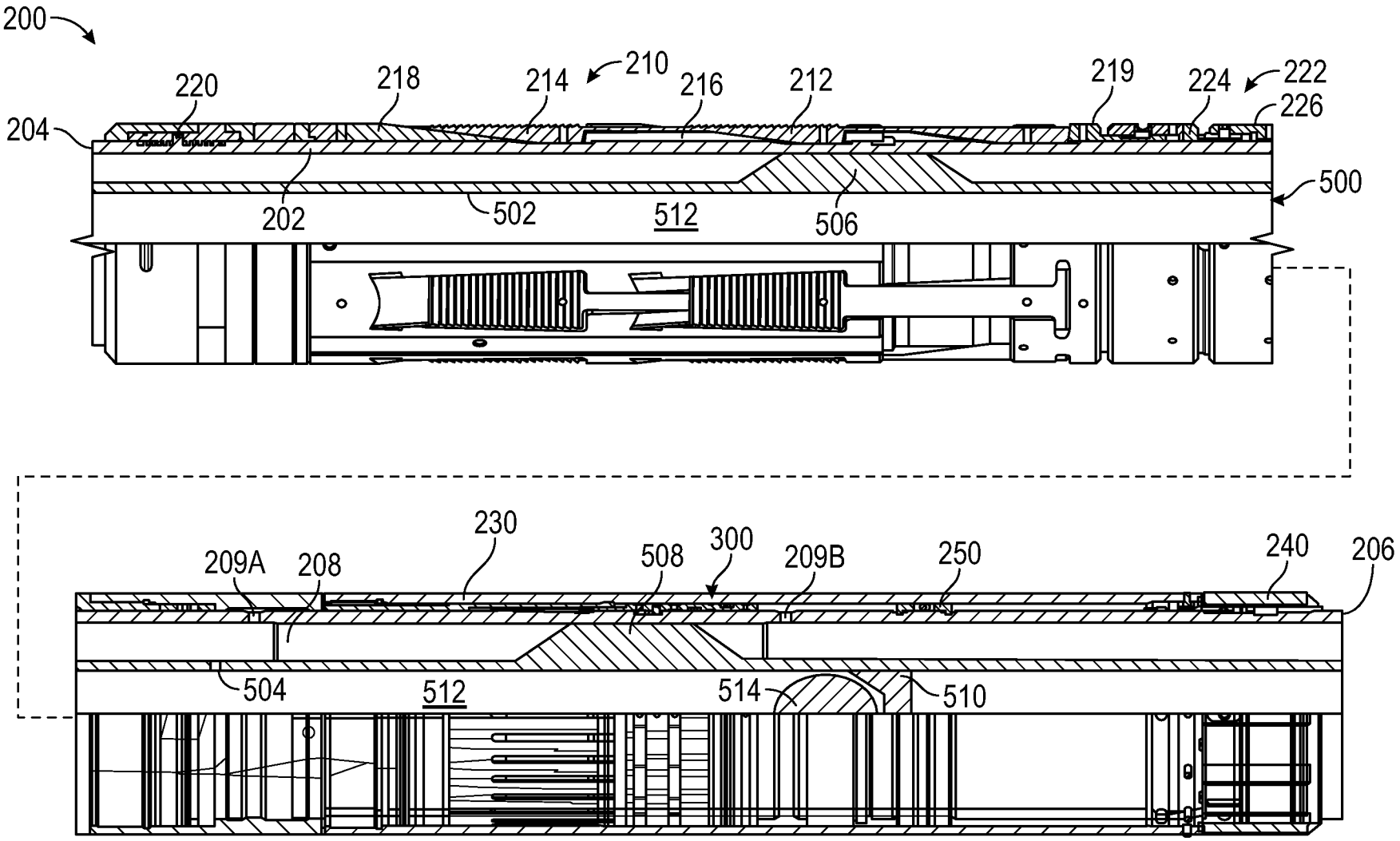
FIG. 5 illustrates a side, cross-sectional view of the liner hanger including a setting assembly, according to an embodiment.

A setting assembly is provided as part of the liner hanger 200 to generate such different pressures as between the first port 209A and the second port 209B. FIG. 5 illustrates a side, cross-sectional view of the liner hanger 200 including such a setting assembly 500, according to an embodiment. The setting assembly 500 is received through the bore 208 of the mandrel 202. The setting assembly 500 may include a base pipe 502, through which a pressure-delivery port 504 is radially defined, as shown.

The setting assembly 500 may also include a first packer 506 and a second packer 508, which may be axially offset from one another. The first and second packers 506, 508 may be coupled to, received around, integral with, or otherwise extended into the mandrel 202 along with the base pipe 502. The pressure-delivery port 504 may be positioned axially between the first and second packers 506, 508.

The setting assembly 500 may also include a valve seat 510, which may be positioned within an internal bore 512 of the setting assembly 500. The valve seat 510 may be configured to catch an obstructing member 514, such as a dart or, as shown, a spherical ball. The obstructing member 514, when landed on the seat 510, may obstruct fluid flow through the bore 512 of the base pipe 502.

It will be appreciated that, in some embodiments, the mandrel 202 may extend farther axially uphole than shown, e.g., to a position that may be uphole of the upper collar 220, and likewise, farther axially downhole than shown, e.g., to a position that may be downhole of the lower collar 240. As such, for example, the first packer 506 may be positioned uphole of upper collar 220, and the valve seat 510 may be positioned downhole of the lower collar 240.

In operation, the setting assembly 500 may be positioned within the mandrel 202. In particular, the first packer 506 may be positioned uphole of the first port 209A, and the second packer 508 maybe positioned axially between the first port 209A and the second port 209B. The first and second packers 506, 508 may be positioned or otherwise actuated so as to at least partially seal with the mandrel 202. Further, the obstructing member 514 may be deployed into the valve seat 510. Accordingly, pressure may be delivered through the base pipe 502, via the bore 512, and directed into the pressure-delivery port 504 by the obstructing member 514 engaging the valve seat 510. The pressure is received through the pressure-delivery port 504, into the bore 208 of the mandrel 202 between the first and second packers 506, 508. As the packers 506, 508 prevent pressure from moving axially away, the pressure is delivered to the first port 209A, and not to the second port 209B, which is on the opposite axial side of the second packer 508.

Accordingly, referring again additionally to FIGS. 3 and 4, the pressure in the first port 209A may be raised to above the pressure in the second port 209B, which may result in a sufficient (e.g., predetermined) pressure differential developing across the piston 304 in the annulus 232 to shear the shearable member 316 and actuate the retaining assembly 300 into the second configuration. As noted above, this releases the outer cylinder 230, allowing the outer cylinder 230 to cause the slips 212, 214 to be pressed radially outward, thereby anchoring the liner hanger 200.

Figure 6:
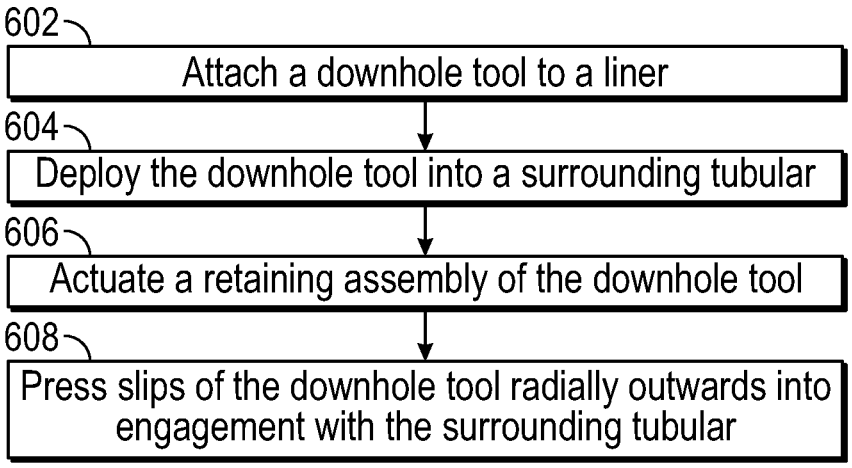
FIG. 6 illustrates a flowchart of a method for setting a downhole tool in a surrounding tubular, according to an embodiment.

FIG. 6 illustrates a flowchart of a method 600 for setting a downhole tool in a surrounding tubular, e.g., the liner hanger 200 in a casing. The method 600 may include attaching the downhole tool to a liner, as at 602, so as to hang the liner from the downhole tool set in the casing.

The method 600 may also include deploying the downhole tool (e.g., along with the liner) into the surrounding tubular, as at 604. When deployed to a certain position, e.g., near a lower end of the casing, the method 600 may include actuating a retaining assembly of the downhole tool from a first configuration to a second configuration by increasing a pressure differential between first and second ports of a mandrel of the tool, as at 606, and consistent with the embodiments of the liner hanger 200 discussed above. Actuating at 606 may free an outer cylinder of the downhole tool to press upward, e.g., in response to a force generated by pressure in the wellbore below the downhole tool. This may cause a slips assembly (in particular, the slips thereof) to be pressed radially outwards into (e.g., anchoring) engagement with the surrounding tubular, as at 608.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a mandrel configured to be coupled to a liner, the mandrel defining a first port and a second port, the first and second ports extending radially through a wall of the mandrel, and the first port being above the second port;

a slips assembly coupled to the mandrel;

an outer cylinder received around the mandrel and configured to transmit an axially-directed force onto the slips assembly; and a retaining assembly comprising a piston that is positioned radially between the mandrel and the outer cylinder, wherein the retaining assembly has a first configuration that prevents the outer cylinder from moving relative to the mandrel, and a second configuration that permits the outer cylinder to move axially along the mandrel and set the slips assembly, and wherein the piston is configured to move downward as the retaining assembly actuates from the first configuration to the second configuration in response to a pressure in the first port exceeding a pressure in the second port.

2. The downhole tool of claim 1, wherein the retaining assembly comprises a detent ring having an enlarged section, wherein, in the first configuration, the enlarged section is received into a recess formed in the outer cylinder, and wherein, in the second configuration, the enlarged section is pressed radially inward from the recess, wherein the piston is configured to prevent the enlarged section of the detent from moving radially inward in the first configuration, wherein the piston is configured to permit the enlarged section of the detent to move radially inward in the second configuration.

3. The downhole tool of claim 2, wherein, in the first configuration, the piston is at least partially radially between the mandrel and the detent ring, and in the second configuration, the piston is not radially between the mandrel and the detent ring.

4. The downhole tool of claim 2, wherein the piston comprises one or more seals configured to prevent pressure communication between the first and second ports via an annulus defined radially between the outer cylinder and the mandrel, and wherein, in the second configuration, the piston sealingly blocks the second port.

5. The downhole tool of claim 2, wherein the retaining assembly comprises a shear member that holds the piston in place in the first configuration, and wherein the shear member shears in response to the pressure in the first port exceeding the pressure in the second port by a predetermined amount.

6. The downhole tool of claim 1, further comprising a setting assembly received into the mandrel, wherein the setting assembly is configured to increase a pressure in the first port and not increase a pressure in the second port.

7. The downhole tool of claim 6, wherein the setting assembly comprises a base pipe having a port therein and a first packer, the first packer being configured to be positioned between the first and second ports and to form a seal with the mandrel, wherein the pressure directed to the first port is received therein via the port in the base pipe, and wherein the first packer is configured to prevent the pressure from reaching the second port.

8. The downhole tool of claim 7, wherein the setting assembly further comprises a second packer positioned uphole from the first packer and configured to be positioned uphole of the first port, and a valve seat positioned downhole of the first packer within the base pipe.

9. The downhole tool of claim 8, wherein the valve seat is configured to catch an obstruction member therein, so as to direct the pressure through the port in the base pipe.

10. The downhole tool of claim 1, further comprising a ring positioned axially between the outer cylinder and the slips assembly, wherein, in response to the retaining assembly being in the second configuration, the outer cylinder is configured to press axially against the ring to force slips of the slips assembly radially outwards into engagement with a surrounding tubular.

11. The downhole tool of claim 1, wherein the piston covers the second port and prevents fluid flow therethrough in the second configuration.

12. A method for setting a downhole tool in a surrounding tubular, comprising:

deploying the downhole tool into the surrounding tubular, the downhole tool comprising:

a mandrel configured to be coupled to a liner, the mandrel defining a first port and a second port, the first and second ports extending radially through a wall of the mandrel, and the first port being above the second port;

a slips assembly coupled to the mandrel;

an outer cylinder received around the mandrel and configured to transmit an axially-directed force onto the slips assembly; and a retaining assembly comprising a piston that is positioned radially between the mandrel and the outer cylinder, wherein the retaining assembly has a first configuration that prevents the outer cylinder from moving relative to the mandrel, and a second configuration that permits the outer cylinder to move axially along the mandrel and set the slips assembly, and wherein the piston is configured to move downward as the retaining assembly actuates from the first configuration to the second configuration in response to a pressure in the first port exceeding a pressure in the second port;

actuating the retaining assembly from the first configuration to the second configuration by increasing a pressure differential between the first and second ports in the mandrel; and after actuating the retaining assembly, pressing the slips assembly radially outwards into engagement with the surrounding tubular.

13. The method of claim 12, wherein increasing the pressure differential between the first and second ports comprises:

positioning a first packer of a setting assembly within the mandrel and uphole of the first port; and positioning a second packer of the setting assembly within the mandrel and downhole of the first port and uphole of the second port.

14. The method of claim 13, wherein increasing the pressure differential further comprises:

catching an obstructing member in a valve seat within a base pipe of the setting assembly; and routing pressure from within the base pipe through a pressure-delivery port in the base pipe that is axially between the first and second packers.

15. The method of claim 12, wherein actuating the retaining assembly comprises moving the piston of the retaining assembly away from a detent ring of the retaining assembly, such that an enlarged section of the detent ring is movable radially out of a recess formed in the outer cylinder.

16. The method of claim 12, wherein pressing the slips assembly radially outwards comprises applying an axial force against the slips assembly using the outer cylinder.

17. The method of claim 16, wherein applying the axial force comprises using a pressure within a wellbore in which the downhole tool is deployed, to push the outer cylinder axially uphole.

18. The method of claim 12, wherein the surrounding tubular comprises a casing, and wherein the downhole tool comprises a liner hanger, the method further comprising connecting a liner to a downhole end of the liner hanger.

19. A downhole tool, comprising:

a mandrel configured to be coupled to a liner, the mandrel defining a first port and a second port, the first and second ports being axially offset from one another and extending radially through a wall of the mandrel;

a slips assembly coupled to the mandrel;

an outer cylinder received around the mandrel and configured to axially engage the slips assembly; and a retaining assembly positioned radially between the mandrel and the outer cylinder, wherein the retaining assembly has a first configuration that prevents the outer cylinder from moving relative to the mandrel, and a second configuration that permits the outer cylinder to move axially along the mandrel and set the slips assembly, wherein the retaining assembly is configured to actuate from the first configuration to the second configuration in response to a pressure in the first port exceeding a pressure in the second port, wherein the retaining assembly comprises:

a detent ring having an enlarged section, wherein the enlarged section is received into a recess in the outer cylinder in the first configuration, and wherein the enlarged section is pressed radially inward from the recess in the second configuration; and a piston that prevents the enlarged section of the detent from moving radially inward in the first configuration, wherein the piston permits the enlarged section of the detent to move radially inward in the second configuration, wherein, in the first configuration, the piston is at least partially radially between the mandrel and the detent ring, and in the second configuration, the piston is not radially between the mandrel and the detent ring, and wherein the piston covers the second port and prevents fluid flow therethrough in the second configuration.

20. The downhole tool of claim 19, wherein the retaining assembly comprises a shear member that holds the piston in place in the first configuration, and wherein the shear member shears in response to the pressure in the first port exceeding the pressure in the second port so as to actuate the retaining assembly from the first configuration to the second configuration.

21. The downhole tool of claim 19, further comprising a setting assembly received into the mandrel, wherein the setting assembly is configured to increase a pressure in the first port and not increase a pressure in the second port, and wherein the setting assembly comprises:

a base pipe having a port therein that communicates with the first port of the mandrel;

a first packer coupled to the base pipe and positioned uphole of the first port of the mandrel;

a second packer coupled to the base pipe, and axially offset from the first packer such that the port is positioned axially between the first and second packers, wherein the second packer is axially between the first and second ports of the mandrel such that the second packer prevents communication between the port of the base pipe and the second port of the mandrel; and a valve seat within the base pipe and downhole of the port of the base pipe.

* * * * *